United States Patent [19]

Coppin

[11] Patent Number: 4,869,665

[45] Date of Patent: Sep. 26, 1989

[54] CARBON MONOXIDE REDUCING ENDPLATE APPARATUS

[75] Inventor: William Coppin, Muncie, Ind.

[73] Assignee: Maxon Corporation, Muncie, Ind.

[21] Appl. No.: 32,596

[22] Filed: Apr. 1, 1987

[51] Int. Cl.[4] ..... F23D 14/20

[52] U.S. Cl. ..... 431/351; 431/350

[58] Field of Search ..... 432/222; 431/350, 351, 431/352, 354

[56] References Cited

U.S. PATENT DOCUMENTS

| | | | |
|---|---|---|---|
| 480,544 | 8/1892 | Balsley | 431/313 |
| 2,199,826 | 5/1940 | Scott | 431/352 X |
| 3,186,697 | 6/1965 | Haedike et al. | 432/222 X |
| 3,592,578 | 7/1971 | Weathenstove | 431/307 X |
| 4,573,407 | 3/1986 | Coppin et al. | 431/351 |

FOREIGN PATENT DOCUMENTS

| | | | |
|---|---|---|---|
| 912435 | 10/1972 | Canada | 431/351 |
| 0162239 | 12/1979 | Japan | 431/351 |

*Primary Examiner*—Albert J. Makay
*Assistant Examiner*—Carl D. Price
*Attorney, Agent, or Firm*—Cook & Egan, Ltd.

[57] ABSTRACT

The improvement of the present invention is directed to an endplate which is disposed at the end of a gaseous fuel burner body forming the flame-containing space. Such endplate has a portion which extends substantially above the top edge of the mixing plates. The endplate may have lateral sides which extend beyond the lateral extent of the endplate body to shield and protect the apertures disposed within the longitudinal extent of the mixing plates also to shield the flame on the lateral sides of the mixing plates disposed near the endplate. The endplate improvement of the present invention serves to substantially reduce secondary air from chilling the flame near the end of the burner, and thereby substantially reducing the formation of carbon monoxide, which is formed preferentially to carbon dioxide in reduced temperature flames.

10 Claims, 1 Drawing Sheet

CARBON MONOXIDE REDUCING ENDPLATE APPARATUS

BACKGROUND OF THE INVENTION

The present invention is directed generally to the gaseous fuel burner arts, and more particularly to an improvement for use in connection with lineal gaseous fuel burner apparatus and comprising a mechanism for reducing the cooling of the combustion flame near the end of a section of the particular lineal burner as may be caused by secondary air.

In the prior art, gaseous fuel burners have frequently functioned particularly well in preventing relatively high levels of carbon monoxide. One reason for such efficient functioning of gaseous fuel burning apparatus to produce preferentially carbon dioxide rather than carbon monoxide has been that such burners have been permitted to utilize flame temperatures in excess of approximately 1400° F. to 1450° F., and have been sufficient to prevent any substantial portion of the flame to burn at temperatures as low as 1200° F.

However, such burners are not without certain difficulties. For example, when sections of such lineal disposed gaseous fuel burners are relatively short in length, such as for example any burner section less than 6 feet, a phenomenon which has been designated as "endplate effect" may occur. Specifically, a relatively greater amount of the flame disposed within the trough defined by the mixing plates is necessarily disposed near the endplates.

Such endplate effect may be quantitatively referred to with regard to the designated "endplate ratio", which is defined as the number of endplates divided by the length in feet of the burner. For example, a six foot burner would have an endplate ratio of 0.33, or 2 endplates divided by 6 feet equals 0.33. A further example would be a 12" burner which would have an endplate ratio of 2.0.

What the endplate effect has meant in practical terms is an increase in the level of carbon monoxide produced by the flame, to an extent that in several such instances these burners will no longer meet the required standards for use in various industries and applications, and especially where such levels of carbon monoxide approach or exceed 6 parts per million (ppm).

In view of the above difficulties and deficiencies experienced with otherwise satisfactory prior art gaseous fuel burners, it has become necessary to analyze the possible causes of such problems, and to suggest methods and apparatus for curing or at least substantially ameliorating such problems.

Accordingly, and in view of the above difficulties and deficiencies of prior art gaseous fuel burning apparatus, it has been one object of the present invention to materially reduce such difficulties and deficiencies, and more particularly to provide an improved mechanism by which carbon monoxide emissions may be substantially reduced and especially where such short sections of gaseous fuel burning apparatus are utilized.

The present invention may be better understood by those of at least ordinary skill in the art by reference to the following summary of the invention, brief description of the drawing, detailed description of preferred embodiments, appended claims and accompanying drawing.

SUMMARY OF THE INVENTION

The present invention is directed to an improvement for use in association with various gaseous fuel burning apparatus, and particularly of the type utilizing mixing plates having air apertures therein and which are typically disposed in a V-shaped array to form a combustion flame-containing trough.

The improvement of the present invention is directed to an endplate of a particular configuration which is disposed at the end of the burner body forming the flame containing space. Such endplate is disposed transversely to the longitudinal dimension of the mixing plates and has a portion which extends substantially above the top edge of the mixing plates. In other preferred embodiments, the endplate has lateral sides which extend beyond the lateral extent of the endplate body to shield and protect the apertures disposed within the longitudinal extent of the mixing plates, and also to shield the flame on the lateral sides of the mixing plates disposed near the endplate.

The functioning of the endplate improvement of the present invention is to substantially reduce secondary air from chilling the flame near the end of the burner, and thereby substantially reducing the formation of carbon monoxide, which is formed preferentially to carbon dioxide in reduced temperature flames.

BRIEF DESCRIPTION OF THE DRAWING

The improved carbon monoxide reducing endplate apparatus of the present invention is depicted in the accompanying drawing, and in which.

DETAILED DESCRIPTION OF PREFERRED EMBODIMENTS

Figure 1:
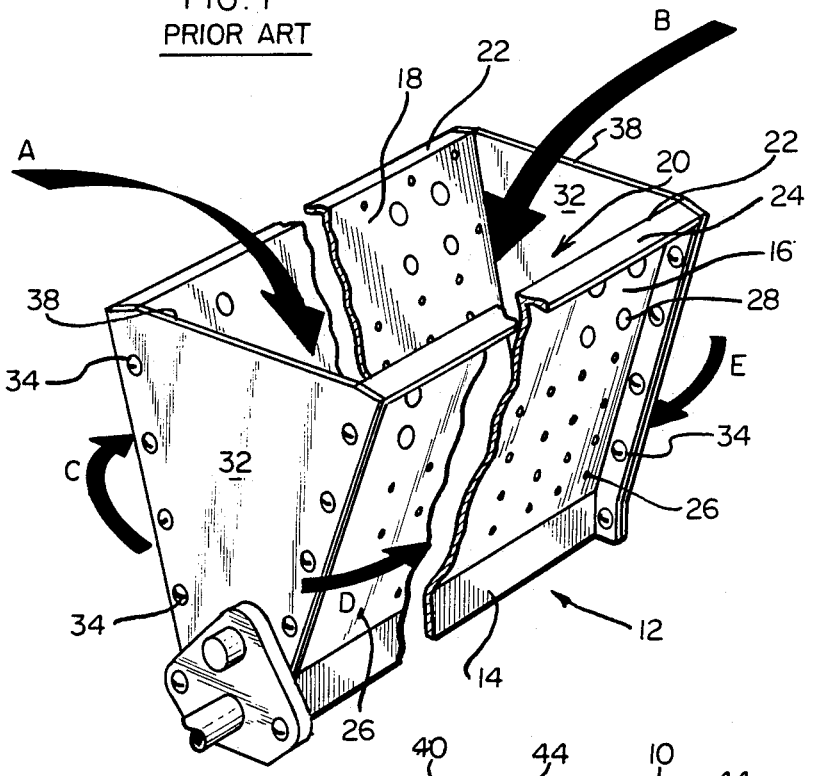
FIG. 1 PRIOR ART
FIG. 1 depicts a perspective view of a prior art lineal burner without installation of the improved carbon monoxide reducing endplate apparatus of the present invention.

The improved carbon monoxide reducing endplate apparatus of the present invention is directed to certain shielding apparatus adapted for use in connection with gaseous fuel burners.

In such burners, a burner body is provided and which has at least one longitudinal dimension. Other arrays, such as L-shaped, T-shaped, or I-shaped configurations are commonly utilized. Another possibility is a substantial length of a main or "trunk" burner body with a plurality of shorter "branch" burner bodies disposed generally perpendicularly thereto and in spaced array, each one of which "branch" burner bodies has an endplate at the end thereof. The burner body thereof has a plurality, and preferably a pair, of mixing plates which are disposed (and most usually in V-shaped array) to define an at least partially flame-containing space. Such gaseous fuel burning apparatus also may have a portion of the flame extending above the top edge of the mixing plates when operated over at least some of the range of the gaseous fuel burner. Of course, in maximum turn down, such gaseous fuel burner apparatus may have its combustion flame entirely enclosed within the flame containing space.

The mixing plates of the gaseous fuel burner-related apparatus of the present invention have a plurality of aeration apertures extending along the longitudinal dimension thereof. The improved endplate apparatus of the present invention is disposed at an end of the burner body forming a flame-containing space and is further disposed transversely to the longitudinal dimension of the mixing plates.

Such improved endplate apparatus further has a portion thereof extending substantially above the top edge of the mixing plates for shielding the flame projecting above the top edge of the mixing plates to substantially reduce secondary air from chilling the flame near the end of such burner body. When such chilling of the combustion flame occurs, substantially increased levels of carbon monoxide would be formed, and accordingly the improved endplate apparatus of the present invention functions to materially reduce carbon monoxide formation by reason of its preventing the reduction in temperature of the burner flame.

Such endplate apparatus may further include in preferred embodiments lateral shielding means for shielding the aeration apertures located near the end of the mixing plates for further substantially reducing impingement of second air upon the aeration apertures. Such functioning further serves to reduce the carbon monoxide formation by reason of combustion at any such reduced flame temperatures. Such lateral shielding means may preferably comprise a lateral portion of the endplate extending in transverse cross-section laterally beyond the mixing plates of the burner body.

Such improved endplate apparatus may further comprise outwardly extending fins disposed in projecting array from the lateral portions of the endplate. Such lateral portions are preferably the side portions thereof. Such outwardly extending fins are further disposed in preferred embodiments in essentially perpendicular array to the plane of the endplate body. Such outwardly extending fins may be preferably disposed along substantially the entirety of the lateral sides of the endplate body.

The burner for use in connection with the improved endplate carbon monoxide reducing apparatus of the present invention may further include mixing plates which are disposed in substantially V-shaped array to form a substantially V-shaped trough for containing at least a portion of the combustion flame, over some ranges of operation of the burner. The body portion of the endplate apparatus may be essentially rectangular in shape in preferred embodiments. Such endplate apparatus may extend approximately 6 inches above the top edge of the mixing plates.

Such endplate apparatus may further preferably comprise a lower portion which extends a substantial distance below the level of the mixing plates to provide further shielding against the secondary air chilling the combustion flame. Such lower portion may preferably extend downwardly from the burner body for a distance of approximately 3 to 6 inches.

Such burner bodies as used in connection with the improved endplate apparatus of the present invetion typically may have a length in longitudinal dimension thereof of less than approximately 6 feet for maximum carbon monoxide reduction capacity. In such embodiments, the endplate factor of the burner is found to be greater than approximately 0.33. The flame temperature of the combustion flame which is substantially adjacent to the endplate is maintained at preferred embodiments at approximately at least 1400° F. In such embodiments, the carbon monoxide level produced by such burner is preferably reduced to at least approximately 3 parts per million.

Figure 2:
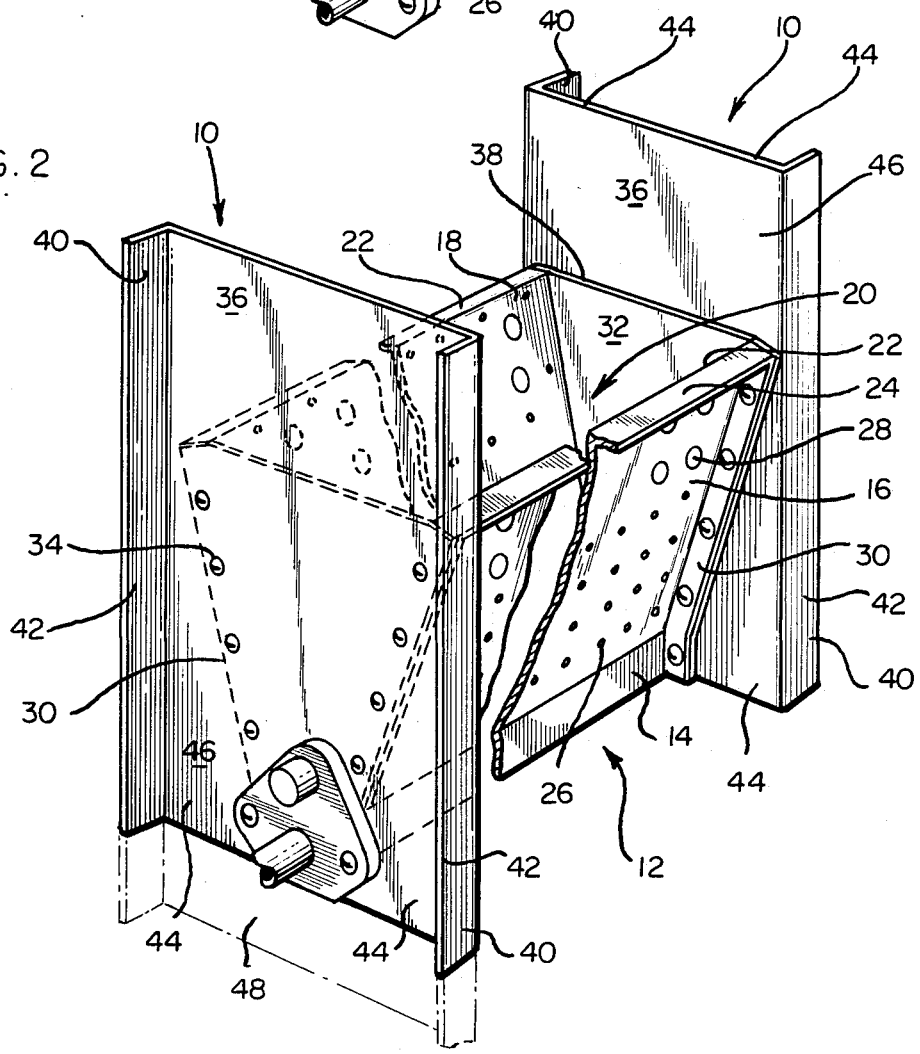
FIG. 2 is a perspective view of the improved carbon monoxide reducing apparatus of the present invention illustrating the positioning of the mixing plates of the burner body (shown fragmented) of such lineal burner disposed in V-shaped array, and showing the bolts for securing such mixing plates to the endplate of the present invention, and further showing the extended top and bottom portions of such endplate body above and below, respectively, the level of such burner body, and the lateral extending shielding means for reducing the amount of cooling air which will enter the aeration apertures of the mixing plates pursuant to such endplate effect.

Referring now to the drawing and to FIGS. 1 and 2 in particular, the improved carbon monoxide reducing endplate apparatus of the present invention generally depicted at 10 is directed to certain apparatus adapted for use in connection with a gaseous fuel burner generally 12. In such burners 12, a burner body 14 is provided and which has at least one longitudinal dimension. Burner body 14 thereof has a pair of mixing plates 16,18 which are disposed to define an at least partially flame containing space or trough generally 20. Such gaseous fuel burner 12 also has a portion of the flame extending above the top edge 22 of mixing plates 16,18 which may comprise a lipped rim 24, when operated over at least some of the range of the gaseous fuel burner. Of course, in maximum turn down, such gaseous fuel burner apparatus may have its combustion flame entirely enclosed within the flame-containing space 20.

Mixing plates 16,18 of gaseous fuel burner 12 have a plurality of smaller aeration apertures 26 in several rows extending along the longitudinal dimension thereof for maximum turn down use, and one or more rows of layer aeration apertures 28 for operation at higher capacities.

As shown in FIG. 2, the improved endplate apparatus 10 of the present invention is disposed at the end(s) 30,30 of burner body 12, and is further disposed transversely to the longitudinal dimension of mixing plates 16,18. Such endplate 10 may be disposed over trough closure plate 32, which is fixed by a plurality of bolts 34 to mixing plates 16,18. Such endplate 10 further has a top portion 36 thereof extending substantially above the level of the top edge 22 of mixing plates 16,18 for shielding the flame projecting above top edge 22 of mixing plates 16,18. Such shielding results in substantially reducing secondary air as shown at Arrows A,B from "diving over" top edge 22 of mixing plate 16,18 and top edge 38 of trough closure plates 32,32, and thereby chilling the flame near the end of burner body 12. Also "diving around" of such secondary air as shown at Arrows C, D and E of FIG. 1 is substantially reduced, as described more fully hereinbelow. As discussed in greater detail hereinbelow, when such chilling of the combustion flame occurs, substantially increased levels of carbon monoxide are formed, and accordingly the improved endplate apparatus 10 of the present invention functions to materially reduce carbon monoxide formation by reason of its preventing the reduction in temperature of the flame caused by the secondary air of Arrows A–E.

Such endplate 10 may further include in preferred embodiments lateral shielding means for shielding aeration apertures 26,28 located near the end of mixing plates 16,18 for further substantially reducing impingement of second air upon the aeration apertures. Such functioning further serves to reduce the carbon monoxide formation by reason of combustion at any such reduced flame temperatures. Such lateral shielding means may preferably comprise lateral portions 40,40 of endplate 10 extending in transverse cross-section laterally beyond mixing plates 16,18 of burner body 12.

Such lateral portions 40,40 of such endplate 10 may further comprise outwardly extending fins 42,42 disposed in projecting array from lateral portions 44,44 of endplate 10. Such lateral portions 44,44 are preferably the side portions thereof. As shown in FIG. 2, such outwardly extending fins 42,42 are further disposed in preferred embodiments in essentially perpendicular array to the plane of body 46 of endplate 10. Such outwardly extending fins 42,42 may be preferably disposed along substantially the entirety of lateral portions 44,44 of endplate body 46.

In connection with the improved endplate carbon monoxide reducing apparatus 10 of the present invention, the burner 12 used therewith may further include mixing plates 16,18 which are disposed in substantially V-shaped array to form the substantially V-shaped trough for containing a portion of the combustion flame, at some ranges of operation of the burner, as shown particularly in FIG. 1. The body 46 of endplate apparatus 10 may be essentially rectangular in shape in some preferred embodiments. Endplate top portion 36 may extend approximately 6 inches above the top edge of mixing plates.

As shown in FIG. 2, such apparatus may further preferably comprise a lower portion 48 (shown in dotted lines) which may in some embodiments extend a substantial distance below the level of mixing plates 16,18 to provide further shielding against the secondary air chilling the combustion flame. Such lower portion may extend downwardly from burner body 12 for a distance of approximately 3 to 6 inches.

The improved carbon monoxide reducing end plate apparatus of the present invention may be of various configurations and dimensions. The endplate apparatus of the present invention may be substantially rectangular in shape as viewed from the end. Alternative embodiments may be rhomboidal or semi-triangular in shape to match the shape of the burner trough in end view. Other alternative embodiments include round, eliptical and various irregular shapes having substantialy length above the top of the burner trough and below the level of such burner trough in yet other embodiments. One embodiment thereof which has been especially effective has had an overall length of 14.75", a wide of 8" and has included an outwardly projecting lip of 1" in projection.

Several examples of the present invention are now set forth hereinbelow.

SUMMARY OF EXAMPLES

Carbon monoxide levels were reported in excess of 5 ppm, for a Maxon NP-1 Burner® utilizing 12" burner sections and 18" burner sections. The Maxon NP-1 Burner® is available from Maxon Corporation, Muncie, Ind. Carbon monoxide emission levels must be reduced in order to qualify a burner design to ANSI Z 83.4 standards.

The mixing plates on the Maxon NP-1 Burner were checked, and it was theorized that an "endplate effect" was present, and that such an endplate effect may be predominant with smaller burner footages. The endplate effect is summarized in the "endplate factor", which is calculated by dividing the number of endplates by the length of the burner section (in feet). The larger the endplate factor, the larger the endplate effect which is present.

The above end plate theory was explored in various endplate treatments which are set forth in greater detail in the subsequent examples, and which are summarized herein below.

EXAMPLE I

A first end plate treatment was set up to provide a lip at the extreme edge of the endplate. Such a lip comprised an "air dam", which served to "aerate" the endplate. Based thereon, it was further theorized that the rich flame "washing" the endplate was being chilled at the end as a result of the passing air stream. Based thereon, aeration of the endplate was expected to reduce carbon monoxide emissions. The results of such aeration were not optimal, and resulted in only a very minor reduction in carbon monoxide emissions along the order of ½ ppm.

Further, improvement was sought by providing protection to the flame within the burner trough by extending the endplate 6" upwardly. This resulted in a substantial improvement in carbon monoxide emissions, as set forth hereinbelow.

The final modification was to utilize a rectangular endplate, as set forth in the following examples. Such preferably rectangular endplate not only provided protection for the rich center portion of the flame, but also provided for laminar flow behind the mixing plate, and thus further reduced carbon monoxide emission levels.

Tests upon the above endplate design revealed a 37% to 40% reduction in carbon monoxide emissions in the usual cases, and as much as a 60% reduction in several instances.

The following data was collected in regard to examples set forth utilizing the above summarized procedures.

EXAMPLE II

Utilizing an 18" burner section, and having a rated capacity of 750,000 BTU per hour, the burner was operated with the prior art end plates. The flame was a soft flame with yellowish tips and substantial amounts of feathering. The pressure drop was 0.25" water columnar. The air temperature was 39° F. in and 159° F. out, for a change in temperature of 120° F. The carbon monoxide emissions were measured at 6 ppm.

EXAMPLE III(a)

Side profile plates were added to the above Maxon 18" NP-1 burner. The change in temperature was 130° F. The pressure drop was 0.4" water column. The carbon monoxide emission level was measured at 5 ppm.

EXAMPLE III(b)

The above unit was set for rated air volume and at rated capacity of 750,000 BTU per hour and the following measurements were made. The pressure drop was 0.5" water column. The change in temper-ature was 115° F. The carbon monoxide emission level was 5 ppm.

EXAMPLE III(c)

The above burner was set at ½ its rated capacity. The change in pressure was 0.58" water column. The change in temperature was 55° F. The carbon monoxide emission level was measured at 5 ppm.

EXAMPLE III(d)

The gas flow was reset to a rated capacity of 375,000 BTU per hour. The change in temperature was 56° F.

The pressure drop was 0.57" water column. The carbon monoxide emission level was measured at 4.8 ppm.

EXAMPLE III(d)

The capacity of the burner was set at 187,000 BTU per hour. The pressure drop was 0.63" water column. The change in temperature was 24° F. The carbon monoxide emission level was measured at 5 ppm.

EXAMPLE III(f)

The burner was reset at ½ its rated capacity or at 375,000 BTU. The pressure drop was measured at 0.12" water column. The change in temperature was 110° F. The carbon monoxide emission level was 2.5 ppm.

EXAMPLE III(g)

The burner was reset at 187,000 BTU per hour. The pressure drop was 0.15" water column. The change in temperature was 56° F. The carbon monoxide emission level was measured at 2.5 ppm.

EXAMPLE IV(a)

The above burner was fitted with the new carbon monoxide reducing endplates of the present invention. The burner was run in its full rated capacity of 750,000 BTU per hour. The change in temperature was 115° F. The change in pressure was 0.3" water column. The carbon monoxide emission level was measured at 3 ppm.

EXAMPLE IV(b)

The rate of capacity of the burner was cut to 375,000 BTU. The change in temperature was 51° F. The pressure drop was 0.35" water column. The carbon monoxide emission level was measured at 3 ppm.

EXAMPLE IV(c)

The rate of capacity of the burner was again cut to 187,000 BTU per hour. The change in temperature was measured at 25° F. The change in pressure was measured at 0.37" water column. The carbon monoxide emission level was measured at 3 ppm.

EXAMPLE IV(d)

The above burner was run at ½ volume and ¼ of its firing rate. The change in pressure was 0.08" water column. The change in temperature was 50° F. The carbon monoxide emission level was 1.0 ppm.

EXAMPLE IV(e)

The above burner was set at ½ its volume and ½ of its firing rate. The pressure drop was measured at 0.07" water column. The change in temperature was 107° F. The carbon monoxide emission level was measured at 1.5 ppm.

EXAMPLE V

The endplate factor as described hereinabove is a phenomenon which apparently contributes to the emission of carbon monoxide in addition to that which is produced by the main body of the burner. The endplate factor is calculated by dividing the number of endplates by the length of the burner in feet, as shown hereinbelow.

The effectiveness of the improved carbon monoxide reducing end plate apparatus of the present invention may be calculated for particular applications. Specifically, from testing it has been determined that 4½ foot Maxon NP-1 burner produces 4 ppm of carbon monoxide. Thus, the end plate factor is calculated as follows:

End Plate Factor=2/4.5=0.444

There $CO_{basic}+CO_{basic}$ (0.444)=4

$CO_{basic}$=2.77 ppm

When the above value is plugged into recent testing showing a reduction to 3 ppm, the endplate apparatus hereof has an efficiency of 2.77/3=92% efficient.

From the above calculations, it can be predicted what carbon monoxide values will be with and without the improved endplate apparatus 10 of the present invention. Specifically, an 8" length of burner without the endplate invention would be expected to carbon monoxide emissions, as follows:

$$18'' \text{ Length}_{without}=2.77+2.77\ (2/1.5)=6.5 \text{ ppm}$$

$$18'' \text{ Length}_{with}=2.77+2.77\ (2/1.5)=100\%-92\%)=3.06 \text{ ppm}$$

Carbon monoxide emissions of a 4½ foot length with the improved endplate apparatus 10 of the present invention may be calculated, as follows:

$$4\tfrac{1}{2} \text{ Foot Length}_{width}=2.77+2.77\ (2/4.5)(0.08)=2.9 \text{ ppm}$$

Calculations for a 6" section may be calculated, as follows:

$$6'' \text{ length}_{without}=2.77+2.77\ (2/0.5)=13.9 \text{ ppm}$$

$$6'' \text{ length}_{with}=2.77+2.77\ (2/0.5)(0.08)=3.7 \text{ ppm}$$

The endplate ratio for a burner section having a trunk section running 11 lineal feet, and having six short branch sections of approximately 1 foot is calculated, as follows, based upon an endplate for each end of the lineal trunk section and one endplate for the distal end of each of the branch sections:

Endplate ratio for 11 lineal feet with 8 endplates $$=\frac{11}{8}=1.375$$

The following chart sets forth test data which was done on a 1 foot straight section of a Maxon NP-1 standard burner, as follows:

MAXON CORPORATION
R & D LABORATORY
GENERAL TEST DATA SHEET

1' STR. BAR NPI STD. BURNER
21" × 14" Profile
Suction Side North Test

| C.F.H. Per FOOT | DIP PROFILE PRESSURE | AIR TEMP. UPSTREAM (°F.) | AIR TEMP. DOWNSTREAM (°F.) | CO UP-STREAM | CO DOWN-STREAM | CO DIFF. | AIR TEMP. DIFF. |
|---|---|---|---|---|---|---|---|
| 400 | .35" | 19 | 117 | .1 | 7.6 | 7.5 | 98 |
| 500 | .35" | 20 | 137 | 0 | 8.6 | 8.6 | 117 |

-continued

MAXON CORPORATION
R & D LABORATORY
GENERAL TEST DATA SHEET

1' STR. BAR NPI STD. BURNER
21" × 14" Profile
Suction Side North Test

| C.F.H. Per FOOT | DIP PROFILE PRESSURE | AIR TEMP. UPSTREAM (°F.) | AIR TEMP. DOWNSTREAM (°F.) | CO UP-STREAM | CO DOWN-STREAM | CO DIFF. | AIR TEMP. DIFF. | |
|---|---|---|---|---|---|---|---|---|
| 400 | .35" | 26 | 122 | 4.2 | 9.2 | 5.0 | 96 | NPI 1' STR. Bar With end |
| 500 | .35" | 26 | 152 | 4.6 | 10.0 | 5.4 | 126 | Plate extensions |
| 400 | .50" | 26 | 114 | 4.2 | 9.0 | 4.8 | 88 | |
| 500 | .50" | 26 | 137 | 4.2 | 9.4 | 5.2 | 111 | |
| 500 | .35" | 26 | 154 | 4.2 | 9.8 | 5.6 | 125 | NPI 1' STR. Bar with end Plate extensions |
| 500 | .35" | 27 | 174 | 6.4 | 13.4 | 7.0 | 147 | NPI 1' STR. Bar with |
| 500 | .50" | 27 | 152 | 6.4 | 13.0 | 6.6 | 125 | Profile Sides butted up against burner end plates |

The basic and novel characteristics of the improved apparatus of the present invention will be readily understood from the foregoing disclosure by those skilled in the art. It will become readily apparent that various changes and modifications may be made in the form, construction and arrangement of the improved apparatus of the present invention as set forth hereinabove without departing from the spirit and scope of the invention. Accordingly, the preferred and alternative embodiments of the present invention set forth hereinabove are not intended to limit such spirit and scope in any way.

What is claimed is:

1. In a gaseous fuel burner apparatus having a burner body for containing a flame, such burner body with at least one longitudinal dimension, the burner body having a plurality of mixing plates, each said mixing plate having a longitudinal dimension and a top edge, said mixing plates disposed to define a partially flame containing space and for having a portion of the flame extendable above the top edge of such mixing plates, with said mixing plates having a plurality of aeration apertures extending generally along the longitudinal dimension of said mixing plates, the improvement comprising:

endplates disposed at opposing ends of the burner body for forming a flame-containing space, each of said endplates disposed substantially transversely to the longitudinal dimension of the mixing plates, said endplates having lateral sides, and said endplates having an upwardly extending portion extending above the top edge of the mixing plates for shielding the flame projecting above the top edge of the mixing plates for reducing chilling of the flame near said end of the burner body and to reduce formation of carbon monoxide which would have been formed in preference to carbon dioxide by reason of combustion at such reduced flame temperatures, said endplates further including lateral shielding means for shielding the aeration apertures located near said end of the mixing plates for further substantially reducing impingement of secondary air upon the aeration apertures and to further thereby reduce such carbon monoxide which would have been formed by reason of combustion at such reduced flame temperatures, said lateral shielding means further comprising a lateral portion of said endplates extending in transverse cross-section laterally beyond the mixing plates of the burner body, and fins disposed in a projecting array from the lateral portions of said endplates.

2. The carbon monoxide reducing endplates of claim 1 wherein said fins are disposed essentially perpendicular to said endplates.

3. The carbon monoxide reducing endplates of claim 1 wherein said fins are disposed along substantially the entire lateral sides of said endplates.

4. The carbon monoxide reducing endplates of claim 1 wherein the mixing plates are disposed in substantially V-shaped array to form a substantially V-shaped trough for containing a portion of the combustion flame.

5. The carbon monoxide reducing endplates of claim 1 wherein said body portion of said endplates is essentially rectangular in shape.

6. The carbon monoxide reducing endplates of claim 1 wherein said endplates extend approximately 6 inches above the top edge of the mixing plates.

7. The carbon monoxide reducing endplates of claim 1 wherein said endplates further comprise lower portions which extend a substantial distance below the level of the mixing plates to provide further shielding against the secondary air chilling the combustion flame.

8. The carbon monoxide reducing endplates of claim 7 wherein said lower portions extend downwardly from the burner body for a distance of approximately 3–6 inches.

9. The carbon monoxide reducing endplates of claim 1 wherein the burner body has a length in the combined longitudinal dimensions thereof of less than approximately 6 feet.

10. The carbon monoxide reducing endplates of claim 1 wherein the endplate factor of the burner is greater than approximately 0.33.

* * * * *